US005617956A

United States Patent [19]

Werner et al.

[11] Patent Number: 5,617,956

[45] Date of Patent: Apr. 8, 1997

[54] APPARATUS FOR SORTING AND STACKING SHEET MATERIAL

[75] Inventors: Frank Werner; Herbert Maul, both of München; Gerhard Stenzel, Germering, all of Germany

[73] Assignee: Gieseck & Devrient GmbH, Munich, Germany

[21] Appl. No.: 414,791

[22] Filed: Mar. 31, 1995

[30] Foreign Application Priority Data

Mar. 31, 1994 [DE] Germany ..... 44 11 403.6

[51] Int. Cl.[6] ..... B07C 5/00

[52] U.S. Cl. ..... 209/534; 271/298; 271/299; 271/305; 271/315

[58] Field of Search ..... 271/298, 299, 271/303, 305, 178, 184, 185, 187, 315; 209/534

[56] References Cited

U.S. PATENT DOCUMENTS 3,137,499 6/1964 Maidment ..... 271/185
4,236,639 12/1980 Boettge et al. .
4,830,742 5/1989 Takesako ..... 209/534
4,984,692 1/1991 Obara ..... 209/534 X
5,340,099 8/1994 Romanenko et al. ..... 271/305 X

*Primary Examiner*—David H. Bollinger
*Attorney, Agent, or Firm*—Watson Cole Stevens Davis, P.L.L.C.

[57] ABSTRACT

The invention relates to a banknote processing machine wherein the bank notes located in the transport path, after being tested and classified, are delivered from the transport path by means of suitably controlled switches. Deflecting means following the switches and causing rotation and a change of moving direction of the sheets feed the bank notes to the stacking pockets of the stacking units of the bank note processing machine. The entrance ports of the stacking pockets are preferably aligned perpendicular to the direction of transport.

11 Claims, 4 Drawing Sheets

APPARATUS FOR SORTING AND STACKING SHEET MATERIAL

The present invention relates to an apparatus for sorting and stacking sheet material, in particular papers of value, bank notes and the like, according to the preamble of claim 1.

A bank note processing machine of the abovementioned type is known for example from DE-A 27 29 830. For carrying out these processing operations the bank notes, which are generally supplied by the banks in packets, are first singled and then the individual bank notes conveyed by transport means along a transport path. On the transport path there are test means including a multiplicity of sensors for classifying the bank notes according to various criteria, for example condition, authenticity and denomination, and assigning them to different stacking units in accordance with the result of testing. The classified bank notes are thereby delivered from the transport path with the aid of controllable switches and fed to stacking means having two stacking units. The stacking units comprise stacking wheels having partitions bent in a spiral shape to form the individual sorter pockets. The stacking units are of modular construction and each have separate drive means that permit independent operation of the stackers. The stacking units are aligned in tandem in relation to the direction of transport. The grid distance, i.e. the distance between two adjacent stacking units, corresponds to at least the diameter of a stacking wheel. If there is a multiplicity of stackers one therefore requires a corresponding amount of space for housing the stackers.

The invention is thus based on the problem of proposing an apparatus for sorting and stacking sheet material that permits a more compact structure of a stacker.

This problem is solved by the features stated in claim 1.

The basic idea of the invention is that the individual sheets located in the transport path, after being delivered from the transport path by means of suitably controlled switches, slide through deflecting means following the switches and causing a rotation and change of moving direction of the sheets toward the stacking units of the stacking means disposed at a certain angle to the transport path.

The advantages obtained with the invention consist in particular in that the rotation and change of moving direction of the sheets caused by the deflecting means permits the stacking units to be disposed at a smaller distance, i.e. at a grid distance that is independent of the diameter of a stacking wheel and depends on the width of the sheet material being processed. This permits a compact structure for a stacker having a plurality of stacking units, thereby considerably reducing the space required by the stacking units in a bank note processing machine. The machine can thus have a smaller design, which also permits more cost-effective production.

According to a preferred embodiment example of the invention the stacking units are disposed parallel side by side, the stacking pockets of the stacking units being aligned perpendicular to the direction of transport. A plurality of stacking units are preferably disposed on a common axis that is aligned parallel to the direction of transport. The stacking units are e.g. spiral pocket stackers driven in synchronism by a motor. However it is also possible to drive the spiral pocket stackers independently of one other via separate motors.

Further embodiments and advantages of the invention will result from the subclaims and the following description, that is explained more closely with reference to the drawings, in which:

Figure 4:
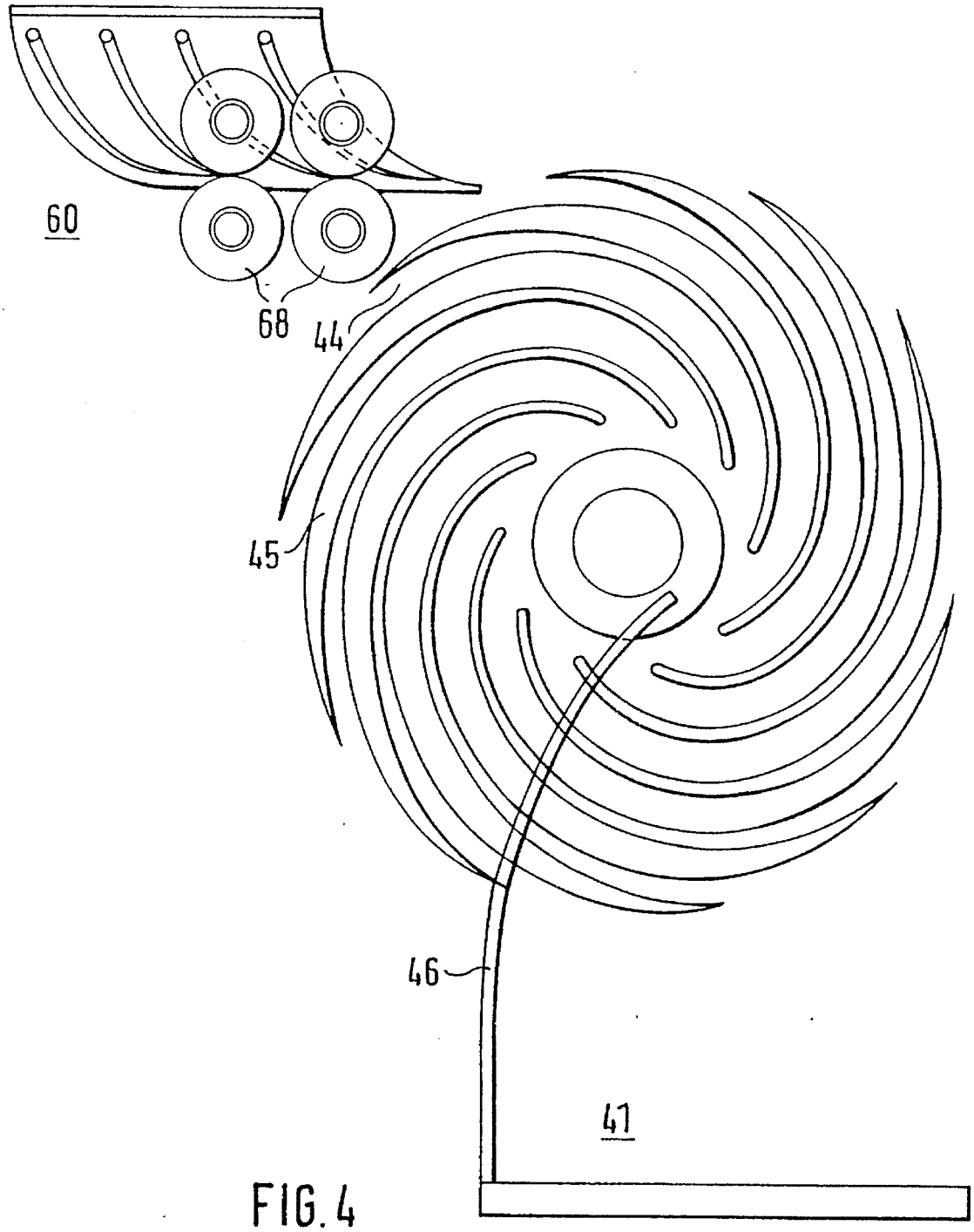

FIGS. *3a*, *3b* show an embodiment example of deflecting means in a plan view and in section, FIG. 4 shows a stacking unit with deflecting means in a side view.

Figure 1:
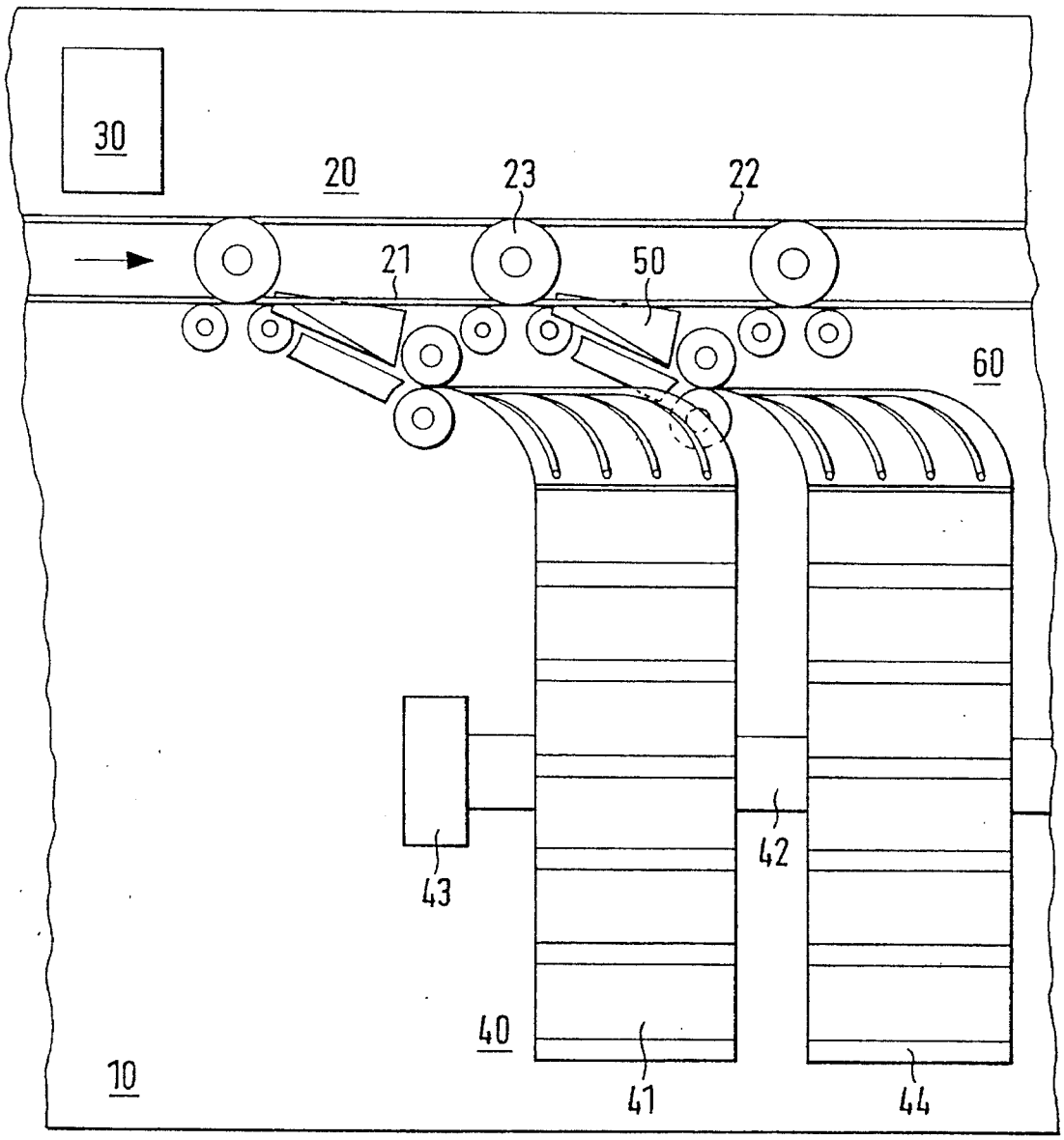
FIG. 1 shows a greatly schematized overall view of the inventive apparatus.

With reference to FIG. 1, the functional principle of apparatus 10 for sorting and stacking loose sheet material, in particular bank notes, will first be explained. The bank notes are generally supplied by the banks banded in packets, debanded in a suitable work unit and then singled. The debanding of the packets and suitable singling means are not part of the invention. They are well known to the expert and will therefore not be described in any detail. The singled bank notes are then picked up by transport means 20 and conveyed along transport path 21. The transport means can be formed for example by transport belts 22 circulating over rolls 23 driven by drive means (not shown). The transport belts can be flat belts or round belts. The detailed structure of a transport device is described in DE-A 27 29 830 and will not be treated in any detail here. The same applies to test means 30, which can comprise a plurality of sensors disposed along transport path 21 and used for testing and classifying the bank notes according to various criteria. Testing can be done for example on condition, authenticity or denomination. In accordance with the result of testing the bank notes are fed to certain stacking units 41 of stacking means 40. Stacking units 41 represent certain sorting classes, e.g. genuine, false, too dirty, etc. The tested bank notes are fed with the aid of controllable switches 50 integrated in transport path 21 that are moved at the command of a control unit (not shown) for delivering the bank notes from the transport path in accordance with the testing and classification for assignment to a certain stacking unit, i.e. sorting class. The bank notes diverted from transport path 21 then pass through deflecting means 60 following the switches and serving to transport the bank notes into stacking pockets 44 of stacking units 41 while rotating them and changing their moving direction in accordance with the switch setting. The entrance ports of the stacking pockets of a stacking unit are preferably aligned perpendicular to the direction of transport, the bank notes guided by the deflecting means being guided in the longitudinal direction directly into the stacking pockets of the corresponding stacking units. Stacking units 41 are preferably disposed parallel side by side on common axis 42 aligned parallel to the transport path. The stacking units are each driven in synchronism with the transport speed of the bank notes to ensure faultless stacking of the bank notes in stacking pockets 44. The arrangement of stacking units 41 on common axis 42 has the advantage that the stacking units can be driven with only one motor 43. Alternatively, it is possible to decouple the stacking units mechanically from one other and to provide each stacking unit with separate drive means. However, this structure of a stacker requires a greater grid distance due to the fact that additional space is needed for disposing the drive means of the stacking units. This additional space can be saved if the stacking units are disposed on a common axis with only one drive means, which results in a very compact structure for a stacker.

Figure 2:
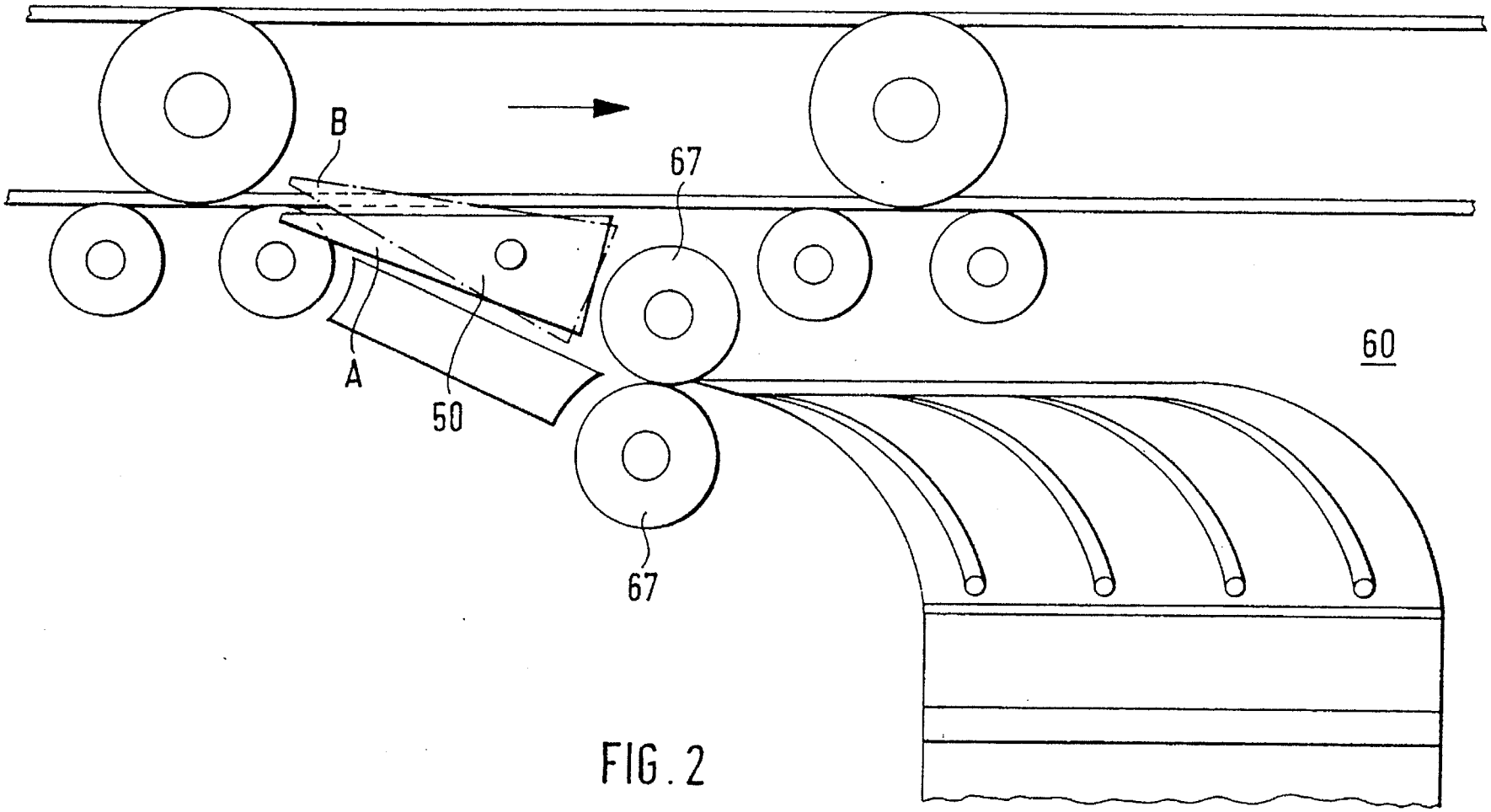
FIG. 2 shows an enlarged detail with a switch and deflecting means.

FIG. 2 shows a detail from apparatus 10 in the area of the deflecting means, including switch 50 that can be moved from inoperative position A into position B for diverting the bank notes in accordance with the test result at the command of a control unit not shown. If the switch is located in position B the bank note hits the switch which feeds the bank note to pair of rolls 67 disposed in the entrance area of deflecting means 60 and driven in synchronism with the transport speed of the bank note.

Figure 3A:
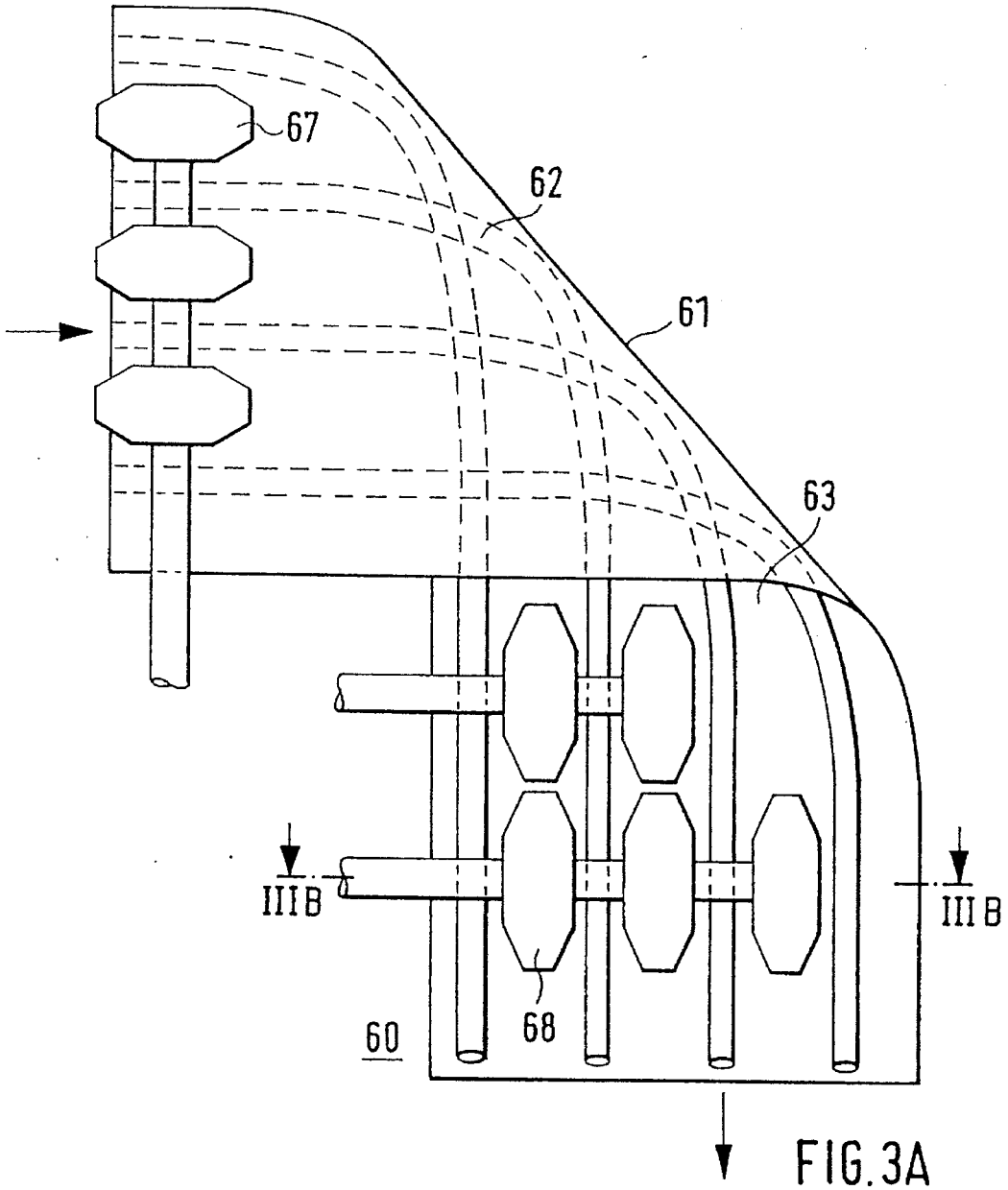
Figure 3B:
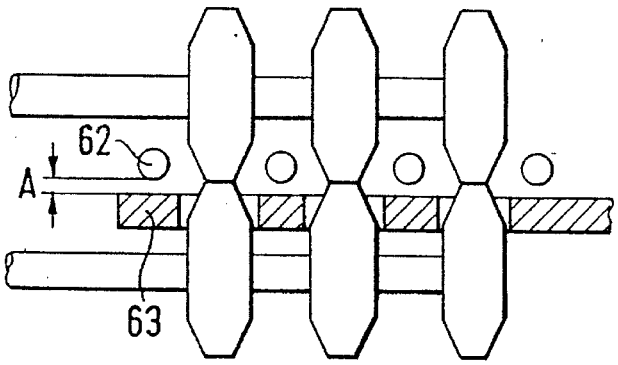

With reference to FIG. 3 the deflecting means will be described more closely. Deflecting means 60 form deflecting path 61 with outer guiding means 63 and inner guiding means 62. The outer and inner guiding means are disposed in a plane guided 90° about a fictitious horizontal cylinder inclined 45° to the transport plane. The outer and inner guiding means of the deflecting path extend parallel and are disposed at constant distance A apart, e.g. 2 mm. This means that the bank notes slide through in the longitudinal direction between the inner and outer guiding means in the deflecting path in such a way that there is no motion perpendicular to the longitudinal direction of the bank notes. The bank notes thus perform a motion that proceeds in the longitudinal direction of the sheets at every point of the conveyed sheet material when passing through the deflecting path. In a preferred embodiment inner guiding means 62 are formed by wires disposed parallel to one other, and outer guiding means 63 by a metal plate. The deflecting means can of course also consist of wires or two plates. Realizing the inner guiding means with wires permits good viewability and accessibility in the case of jammed bank notes. To remedy bank note jams one can remove the traction rolls disposed within the deflecting path. This makes the remedying of bank note jams service-friendly. To ensure that even poor-quality, i.e. limp, bank notes slide into the deflecting path properly, pair of rolls 67 already shown in FIG. 2, and including e.g. three traction rolls in each case, is provided in the entrance area of deflecting means 60. In the exit area of deflecting means 60 there are likewise traction rolls 68 to ensure that even limp bank notes are directed into the stacking pockets of the stacking units properly after actual deflection. For the traction rolls disposed in the entrance area and exit area of the deflecting means the outer guiding means comprising a metal plate are provided with suitable slots to permit clamped guidance of the bank notes by the traction rolls. The geometry of the deflecting means and arrangement of the traction rolls are preferably selected so that even bank notes of different lengths are guided on their optimal deflecting path by the clamped guidance when passing through the deflecting path so that they leave the deflecting means rotated and deflected 90° to the entering direction.

FIG. 4 shows in a side view the entrance area of the bank notes into stacking pockets 44 of stacking unit 41. Traction rolls 68 in the exit area of deflecting means 60 form e.g. two pairs of rolls disposed in tandem. To ensure proper entrance of the bank notes into stacking pockets 44 of stacking unit 41 even at slow transport speeds, a supporting transport belt can additionally be disposed directly following the deflecting means. Stacking unit 41 is preferably designed as a spiral pocket stacker that comprises one or more stacking wheels disposed parallel side by side and having partitions 45 bent in a spiral shape for forming stacking pockets 44. By means of stripper 46 engaging vertically into the partitions of the stacking wheel, the bank notes are delivered and deposited in a tidy stack. For details of the structure and function of the spiral pocket stacker reference is made to DE-A 32 32 348 which precisely describes such a spiral pocket stacker.

We claim:

1. An apparatus (10) for sorting and stacking loose sheet material, in particular papers of value, bank notes and the like, comprising: transport means (20) for moving the sheet material along a transport path (21), test means (30) for testing and classifying the sheet material according to various criteria, stacking means (40) having at least one stacking unit (41) with stacking pockets (44) for receiving the sheet material, at least one switch (50) associated with the stacking unit (41) for diverting the sheet material from the transport path toward said stacking unit (41) of the stacking means (40), said sheet material being assigned to said stacking unit in accordance with the result of testing, said stacking unit being disposed at a certain angle to the transport path, and deflecting means (60) having an outer guide means (63) and inner guide means (62) that are disposed a certain distance apart disposed between said switch (50) and said stacking unit (41) for deflecting said sheet material diverted out of said transport path and rotating said sheet material toward said stacking pockets of said stacking unit (41).

2. The apparatus of claim 1, wherein said stacking unit (41) is disposed perpendicular to said transport path, and said deflecting means (60) form a deflecting path (61) whose entrance and exit direction areas are disposed at right angles to each other.

3. The apparatus of claim 2, wherein said stacking unit (41) is a spiral pocket stacker.

4. The apparatus of claim 3, including an axis (42) and a drive means (43) and wherein a plurality of stacking units (41) are disposed parallel on said axis (42) and driven in synchronism with the transport speed by said drive means (43).

5. The apparatus of claim 4, wherein a plurality of deflecting means (60) are provided for linking up with said stacking units (41), being disposed in tandem in relation to the direction of transport.

6. The apparatus of claim 1, including traction rolls (67) disposed in an entrance area of said deflecting means (60) and driven in synchronism with the transport speed.

7. The apparatus of claim 6, wherein said traction rolls (67, 68) are removable.

8. The apparatus of claim 6, wherein said traction rolls (67, 68) are disposed asymmetrically in entrance and exit areas of said deflecting means (60).

9. The apparatus of claim 1, wherein said outer guiding means (63) are formed of a metal plate and said inner guiding means (62) are formed from wires that are guided in said deflecting path (61) parallel to a longitudinal edge of said bank notes and curves about an axis inclined at 45° to the horizontal.

10. The apparatus of claim 1, including traction rolls (68) disposed in an exit area of the deflecting means (60) and driven in synchronism with the transport speed.

11. The apparatus of claim 1, including traction rolls (67, 68) disposed in an entrance and exit area of the deflecting means (60) and driven in synchronism with the transport speed.

* * * * *